US005595136A

United States Patent [19]

Shinsky

[11] Patent Number: 5,595,136

[45] Date of Patent: Jan. 21, 1997

[54] HARNESS RELEASE DEVICE FOR WATER SKIING

[76] Inventor: Michael Shinsky, 743 15th Ave., Menlo Park, Calif. 94025

[21] Appl. No.: 554,766

[22] Filed: Nov. 7, 1995

[51] Int. Cl.[6] ..... B63B 21/04; B63B 35/85

[52] U.S. Cl. ..... 114/253; 441/69

[58] Field of Search ..... 114/39.2, 253, 114/242, 254; 441/68, 69, 113; 242/405.1, 405.2, 580, 904; 182/3–5

[56] References Cited

U.S. PATENT DOCUMENTS

| | | | |
|---|---|---|---|
| 2,721,088 | 10/1955 | Ritter | 280/480 |
| 3,011,734 | 12/1961 | Wilkinson | 441/69 |
| 3,021,513 | 2/1962 | Lanskey | 340/213 |
| 3,174,702 | 3/1965 | French | 242/405.1 |
| 4,235,182 | 11/1980 | Burger | 440/34 |
| 4,263,685 | 4/1981 | Neuscheler | 9/310 |
| 4,280,240 | 7/1981 | Neuscheles | 9/310 |
| 4,981,098 | 1/1991 | Lickle | 114/253 |
| 5,449,309 | 9/1995 | McCarty | 441/69 |

FOREIGN PATENT DOCUMENTS

| | | | |
|---|---|---|---|
| 2306717 | 11/1976 | France | 114/39.2 |

*Primary Examiner*—Edwin L. Swinehart
*Attorney, Agent, or Firm*—Limbach & Limbach L.L.P.

[57] ABSTRACT

A harness release device for towing a water skier by a harness worn by the skier. The device having a frame and a cylindrical handle with two ends both of which being rotatably attached to and supported by the frame. The handle is freely rotatable about its longitudinal axis. A harness line, having a first end and a second end, is fixedly attached to said frame at the first end. The second end of the harness line is releasably connected to the handle. The releasable connection is formed by winding the second end of the harness line around the handle by rotating the handle in a first direction. The harness engages the harness line whereby if the skier lets go of the handle, the handle spins thus releasing the harness line from the handle and the harness.

14 Claims, 2 Drawing Sheets

HARNESS RELEASE DEVICE FOR WATER SKIING

FIELD OF THE INVENTION

The present invention relates to water skiing, and in particular a device that connects the end of the tow rope to a harness or belt worn by the water skier.

BACKGROUND OF THE INVENTION

Water skiers normally grasp a handle that is attached to the end of a tow rope as they are pulled along the water surface by a motor boat or jet ski. The transverse force created by the boat is transferred to the skier through the skier's arms, which keeps the skier moving on the water surface.

A common complaint among skiers, especially long distance skiers, is that the stress on the skier's arms from being towed by the tow rope is painful and tiring. One solution has been to removably attach the end of the tow rope to a harness or belt worn by the skier. Such a harness pulls the skier along while removing most or all of the transverse force from the skier's arms. Devices have been developed to attach the harness in such a way that if the skier chooses to be released, or falls, that the rope is released from the harness. Examples of such devices are described in U.S. Pat. Nos: 4,235,182, 4,981,098, 4,263,685, and 4,280,240.

There are several drawbacks to these prior art devices. These devices use complex mechanical arrangements, such as mechanical springs, that are employed to overcome the pulling force of the tow line applied to the harness. This force tends to twist the release device during operation and/or jam or slow the release of the harness device during use. It is imperative that such a device immediately release when the skier falls. If the device jams or the release is too slow, the skier may be injured. Another drawback is that some devices employ one or both hands of the skier to operate the release mechanism to retain the connection between the handle and the harness. With such a mechanism, the skier cannot ski with one hand on the handle, and switch hands while skiing. Lastly, none of the prior art references provide a simple means for adjusting the length of the device while skiing so the skier can change the distance between the handle and the harness for different skiing positions and maneuvers.

There is a need for a harness release device that is simple in construction, reliably releases from the skier, allows the skier to ski with only one hand on the handle and to switch hands, and allows the skier to easily adjust the length of the device between the handle and the harness during use.

SUMMARY OF THE INVENTION

The present invention solves the aforementioned problems by providing for a harness release device that releasably connects a tow rope to a harness or belt worn by a water skier. The harness release device provides a handle for the skier to grasp during use with one or both hands, and a means for adjusting the distance between the harness. When the skier falls, the device quickly and reliably releases the harness from the tow rope.

The harness release device includes a frame and a cylindrical handle having two ends that are rotatably attached to and supported by the frame. The handle is freely rotatable about its longitudinal axis. A harness line, having a first end and a second end, is fixedly attached to said frame at the first end. The second end of the harness line is releasably connected to the handle. The releasable connection is formed by winding the second end of said harness line around the handle by rotating the handle in a first direction.

Other objects and features of the present invention will become apparent by a review of the specification, claims and appended figures.

DETAILED DESCRIPTION OF THE PREFERRED EMBODIMENTS

The present invention is a harness release device that releasably connects a tow rope to a harness or belt worn by a water skier. The harness release device provides a handle for the skier to grasp during use with one or both hands, and a means for adjusting the distance between the harness. When the skier falls, the device quickly and reliably releases the harness from the tow rope.

Figure 1:
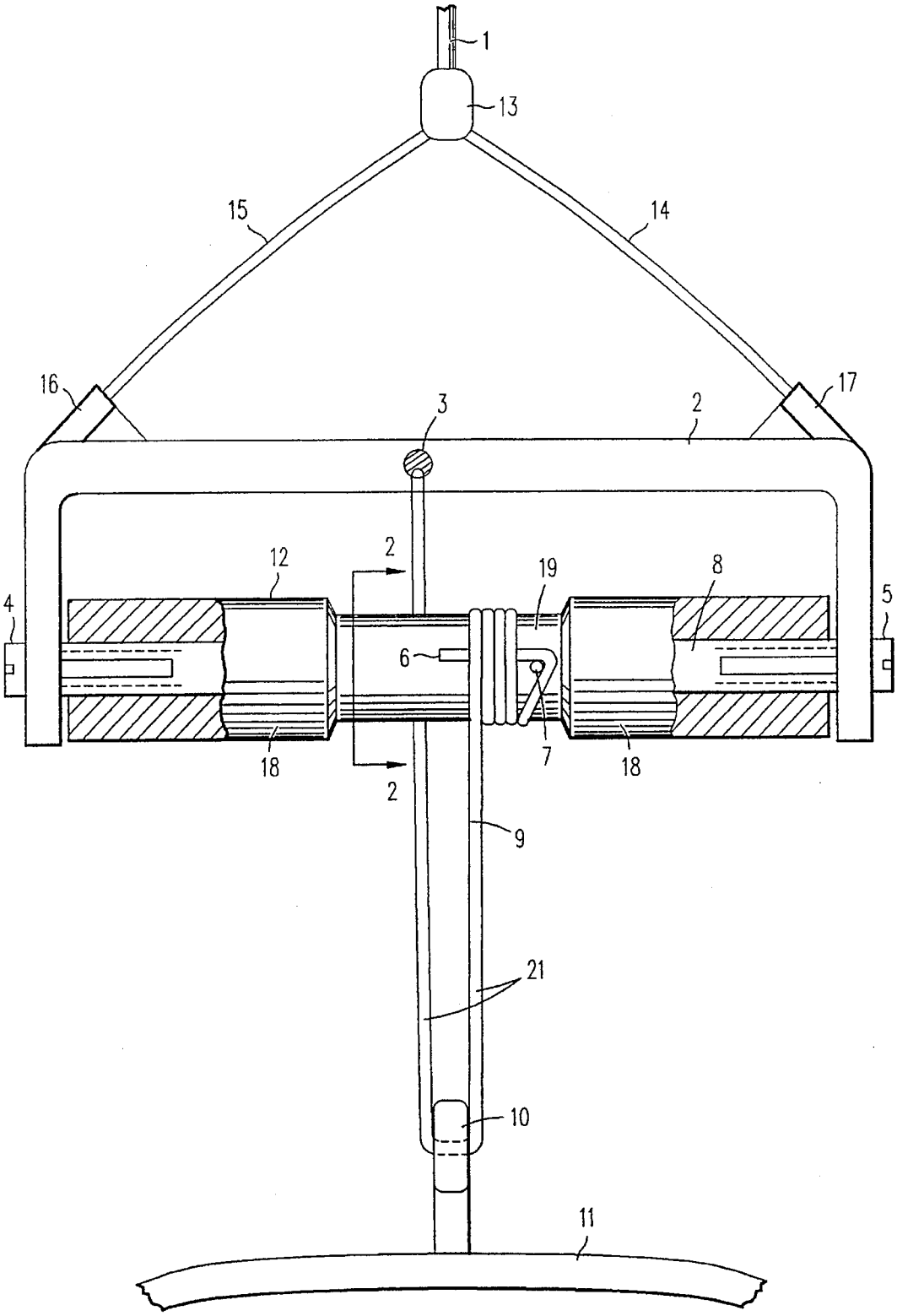
FIG. 1 is a partial broken away top view of the harness release device of the present invention.
Figure 2:
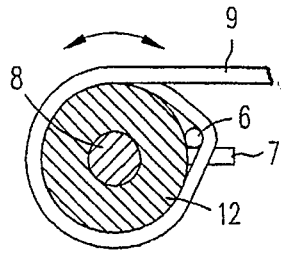
FIG. 2 is a cross-sectional end view of the handle of the present invention.

The harness release device of the present invention is illustrated in FIGS. 1 and 2.

A handle frame 2 is substantially U-shaped with an axle 8 running between the ends of the frame 2. A hollow handle bar 12 is positioned over axle 8 whereby the handle 12 freely rotates around the axle 8. Bolts 4 and 5 secure the axle 8 to the frame 2.

Two yoke lines 14 and 15 are connected to the ends of the handle frame 2 by fittings 16 and 17. The two yoke lines 14 and 15 terminate at fitting 13, which is attached to the end of a tow line 1. The other end of the tow line attaches to a pulling means such as a boat, jetski etc, which is not shown.

The handle 12 has two grip portions 18 and a middle section 19. The handle portions 18 are sized for easy gripping by the skier. The middle section 19 of the handle bar 12 is slightly smaller in diameter than the grip portions 18.

A harness line 9 has a free end 6, and a fixed end that is attached to the frame using an attachment bolt, screw or hole 3. A pin 7 extends out from the middle section 19 of handle 12.

To attach a harness or belt 11 worn by a skier to the harness release device, the free end 6 of harness line 9 is looped through an eyelet or hook 10 of the harness/belt 11. The free end 6 is then wrapped around pin 7 on middle section 19 of handle 12 so that a short section of the harness line extends along the length of handle 12. The handle 12 is then rotated such that the harness line 9 wraps around middle section 19 of handle 12 and thereby overlaps the free end 6 thus securing the harness line to the handle 12.

The skier's grip prevents the handle 12 from rotating and thus unwinding the harness line 9. The distance between the harness 11 and the handle 12 is dictated by the length of the loop 21 of harness line 9 formed between the handle 12 and the attachment bolt, screw, or hole 3. The water skier can adjust the length of the harness line 9 by rotating the handle 12, even while skiing. The harness length adjustment gives the water skier the flexibility to choose the most preferable distance between the harness 11 and the handle 12, thus matching the harness length with the arm length and ski style of the water skier.

If the skier drops the handle 12, either intentionally (wishing to stop) or unintentionally (in the case of a fall), the tension in the harness line 9 will cause the handle to rapidly rotate causing the harness line to unwind off of the middle section 19 and through the harness eyelet/hook 10, thus disengaging the harness 11 from the handle 12. Since the only condition for the release of the harness is the ability of the handle 12 to rotate on axle 8, and the release force results from the towing force, there is very little risk of harness release malfunction.

During use, the skier's grip on one or both of the grip portions must counteract the torsional force on the handle caused by the tension in the harness line. If the torsional force is too great, such as for children or skiers who ski with only one hand on the handle 12, that force can be decreased in several ways. One way is to increase the diameter of the grip portions 18, and/or decrease the diameter of the middle section 19. Preferably, the grip portions 18 have a diameter of about 1.25 to 1.5 inches, and middle section 19 has a diameter of about 0.75 inches.

Figure 3:
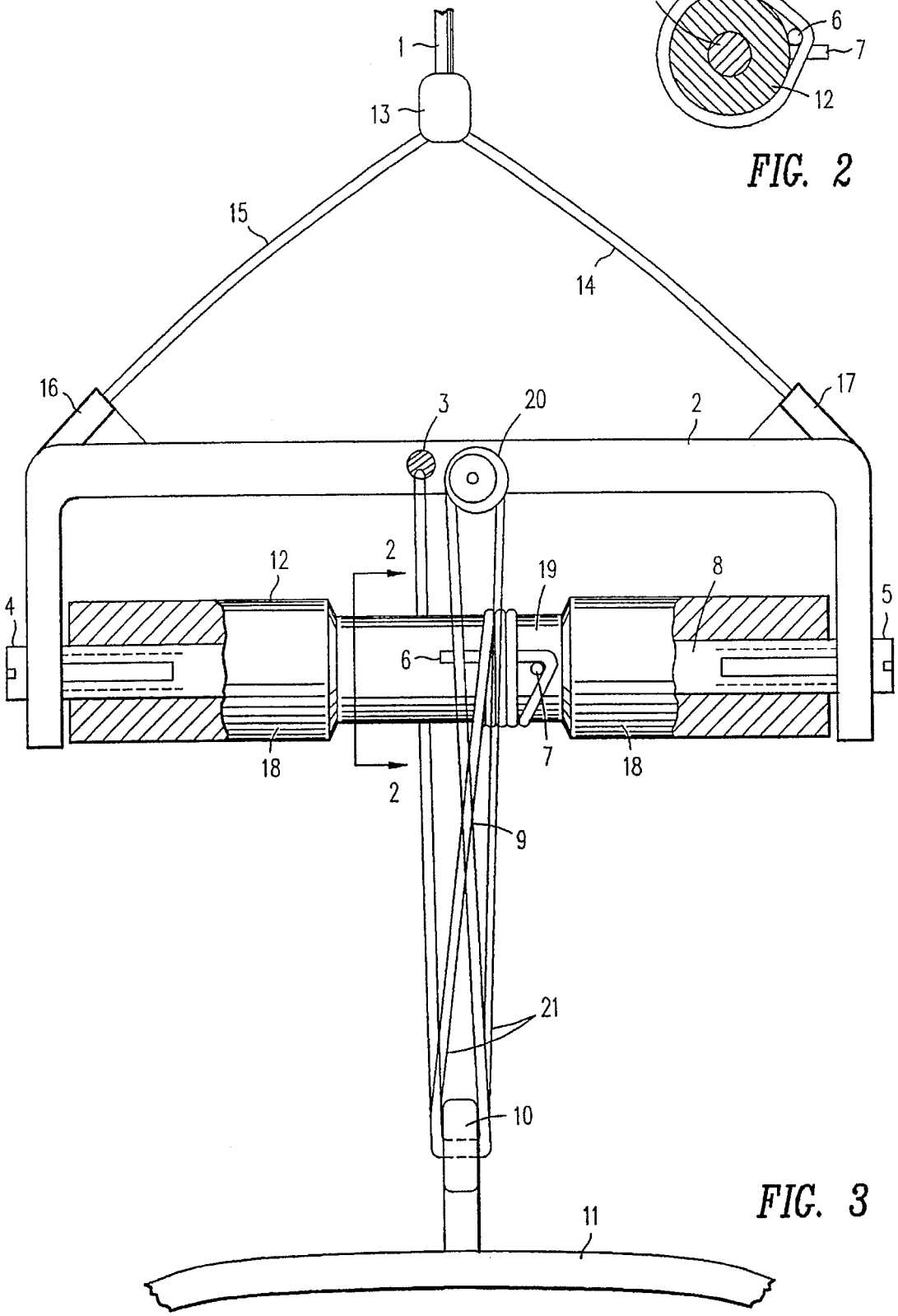
FIG. 3 is a partial broken away top view of the harness release device of the present invention that includes a pulley on the harness line.

Another way to decrease the torsional force on the handle 12 is to add a pulley 20 on the harness line 9, as illustrated in FIG. 3. Pulley 20 is attached to the frame 2. The free end 6 of harness line 9 coming from the harness 11 is looped through the pulley 20 and back through the harness 11 again before being wound around pin 7 and middle section 19 of handle 12. By folding the harness line 9 in this manner, the torsional force applied to the handle 12 is only half of the torsional force without using pulley 20.

The yoke lines 14 and 15 are attached to the ends of frame 2, and the harness line 9 engages the handle 12 near its center, so that the harness release device does not twist during use. Therefore, whether the skier uses one hand or two, the handle 12 and frame 2 stays perpendicular to the tow rope during use.

A portion of the harness worn by a water skier is indicated by reference numeral 11 in FIG. 1. The harness may be of any suitable construction to pull a water skier. For example, the harness may simply be a floatation belt, or a conventional wind surfing harness, or any other device that attaches to the skier and has a hook or eyelet to engage the harness line 9.

The handle frame 2 can be made of any substantially rigid material, such as plastic or metal, and preferably aluminum. The tow, yoke, and harness lines may be formed of any suitable material such as ropes of braided Nylon or the like. The axle 8 is preferably made of steel or bronze. The handle bar 12 is made out of a substantially rigid plastic or metal material, preferably aluminum. Foam or other material may be added over the grip portions 18 for comfort.

It is to be understood that the present invention is not limited to the embodiments described above and illustrated herein, but encompasses any and all variations falling within the scope of the appended claims.

What is claimed is:

1. A water skiing harness release device, comprising:

a frame;

a cylindrical handle having a longitudinal axis and two ends thereof that are rotatably attached to and supported by said frame such that said handle is freely rotatable about said longitudinal axis; and a harness line having a first end and a second end, said first end being fixedly attached to said frame, said second end being releasably connected to said handle, wherein said releasable connection being formed by winding said second end of said harness line around said handle by rotating said handle in a first direction;

wherein said handle is formed of at least two grip portions and a middle section therebetween, said releasable connection being formed on said middle section.

2. The harness release device of claim 1, further comprising:

a pin extending from said middle section of said handle about which said second end of said harness line wraps around to aid in the connection of said harness line to said handle.

3. The harness release device of claim 2, wherein the second end of the harness line wraps around said pin such that said harness line overlaps itself when wound around said handle to secure said harness line to said handle.

4. The harness release device of claim 1, further comprising:

an axle having both ends attached to said frame, said handle rotationally disposed around said axle.

5. The harness release device of claim 1, further comprising:

a pulley attached to said frame and engaged with said harness line to fold said loop of said harness line.

6. A water skiing harness release device for removably attaching a water ski harness worn by a water skier to a tow line being pulled by a towing means, comprising:

a frame having means for attaching to the tow line;

a cylindrical handle having a longitudinal axis and two ends thereof that are rotatably attached to and supported by said frame such that said handle is freely rotatable about said longitudinal axis, said handle being graspable by at least one hand of the skier; and a harness line having a first end and a second end, said first end being fixedly attached to said frame, said second end being releasably connected to said handle, wherein said releasable connection being formed by wrapping said second end around said handle and rotating said handle in a first direction to wind said harness line around said handle, said connection being releasable by rotation of said handle in a second direction opposite to said first direction.

7. The harness release device of claim 6, wherein the portion of said harness line between said first end and said handle forms a loop having a length that is engageable with the harness, said length dictating the distance between the harness and said handle, said length being adjustable by rotation of said handle in said first and second directions.

8. The harness release device of claim 7, wherein said loop length and thus the distance between said handle and the harness gets smaller when said handle is rotated in said first direction.

9. A water skiing harness release device for removably attaching a water ski harness worn by a water skier to a tow line being pulled by a towing means, comprising:

a frame having means for attaching to the tow line;

a cylindrical handle having a longitudinal axis and two ends thereof that are rotatably attached to and supported by said frame such that said handle is freely rotatable about said longitudinal axis, said handle being graspable by at least one hand of the skier; and a harness line having a first end and a second end, said first end being fixedly attached to said frame, said second end being releasably connected to said handle, wherein said releasable connection being formed by wrapping said second end around said handle and rotating said handle in a first direction to wind said harness line around said handle, said connection being releasable by rotation of said handle in a second direction opposite to said first direction;

wherein said handle is formed of at least two grip portions and a middle section therebetween, said releasable connection being formed on said middle section and said middle section having a smaller outer circumference than said grip portions.

10. The harness release device of claim 9, further comprising:

a pin extending from said middle section of said handle about which said second end of said harness line wraps around to aid in the connection of said harness line to said handle.

11. The harness release device of claim 10, wherein the second end of the harness line wraps around said pin such that said harness line overlaps itself when wound around said handle to secure said harness line to said handle.

12. The harness release device of claim 9, wherein:

said frame having first and second ends corresponding to said ends of said handle; and means for attaching said frame to the tow line includes:

a fitting attachable to the tow line; and a first and second yoke lines each having a first end connected to said fitting, and said second ends of said first and second yoke lines attached to said first and second ends of said frame, respectively.

13. The harness release device of claim 12, further comprising:

an axle having both ends attached to said first and second ends of said frame, said handle rotationally disposed around said axle.

14. The harness release device of claim 9, further comprising:

a pulley attached to said frame and engaged with said harness line to fold said loop of said harness line.

* * * * *